US005989643A

United States Patent [19]

Nakagawa et al.

[11] Patent Number: 5,989,643

[45] **Date of Patent: *Nov. 23, 1999**

[54] METHOD OF POSITIONING ROBOTS IN AN AUTOMOBILE PAINTING LINE AND POSITIONING LAYOUT THEREFOR

[75] Inventors: Osamu Nakagawa, Akashi; Masaki Fusama; Masao Naemura, both of Kobe; Yasuhiro Yamaoka, Nagoya, all of Japan

[73] Assignee: Kawasaki Jukogyo Kabushiki Kaisha, Kobe, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/654,386

[22] Filed: May 28, 1996

[30] Foreign Application Priority Data

May 31, 1995 [JP] Japan ..... 7-157168

[51] Int. Cl.[6] ..... B05D 1/02; B05B 7/08

[52] U.S. Cl. ..... 427/424; 427/421; 118/313; 118/314; 118/324

[58] Field of Search ..... 427/8, 421, 424; 118/697, 300, 313, 314, 324; 901/46, 43; 454/50

[56] References Cited

U.S. PATENT DOCUMENTS

| | | | |
|---|---|---|---|
| 3,807,291 | 4/1974 | Roberts et al. | 98/115 SB |
| 4,459,898 | 7/1984 | Harjar et al. | 92/61 |
| 4,609,093 | 9/1986 | Taketani et al. | 198/378 |
| 4,630,657 | 12/1986 | Bambousek et al. | 118/323 |
| 4,690,012 | 9/1987 | Dahlquist et al. | 74/479 |
| 4,698,005 | 10/1987 | Kikuchi et al. . | |
| 4,721,630 | 1/1988 | Takeo et al. | 427/421 |
| 4,977,000 | 12/1990 | Murayama et al. . | |
| 5,020,472 | 6/1991 | Kiba et al. . | |
| 5,103,761 | 4/1992 | Ishibashi et al. | 118/323 |
| 5,127,363 | 7/1992 | Nakamura et al. | 118/695 |
| 5,240,745 | 8/1993 | Yamamoto et al. | 427/421 |
| 5,495,410 | 2/1996 | Graf | 364/191 |

FOREIGN PATENT DOCUMENTS

| | | |
|---|---|---|
| 0 421 791 | 4/1991 | European Pat. Off. . |
| 0 480 663 | 4/1992 | European Pat. Off. . |
| 58-8570 | 1/1983 | Japan . |
| 6-654 | 1/1994 | Japan . |
| 2 190 312 | 11/1987 | United Kingdom . |
| 2190312 | 11/1987 | United Kingdom . |
| WO-95 03133 | 2/1995 | WIPO . |

*Primary Examiner*—Shrive Beck
*Assistant Examiner*—Michael Barr
*Attorney, Agent, or Firm*—Oliff & Berridge, PLC

[57] ABSTRACT

The present invention provides a positioning method and layout that can be used to dispose robots efficiently in an automobile painting and sealing line. This invention relates to the positioning of robots in an automobile painting line in which a downflow circulatory system is established. The main body of a sealing robot is positioned in a location at which it does not cause a large disruption in the downflow circulation along the side of an automobile body, and a robot for painting the under-surface of the floor of the automobile body is provided therebelow. Sealing and painting of the under-surface are performed in parallel.

5 Claims, 13 Drawing Sheets

METHOD OF POSITIONING ROBOTS IN AN AUTOMOBILE PAINTING LINE AND POSITIONING LAYOUT THEREFOR

BACKGROUND OF THE INVENTION

The present invention relates to a method and layout for positioning robots in an automobile painting line. More specifically, it relates to a method and layout for positioning robots that makes it possible to halve the total length of an automobile line, especially in a sealing line and a painting line for applying a rust-prevention material on the automobile body.

In a conventional automobile manufacturing line, a number of robots such as spot-welding robots, sealing robots, and painting robots are disposed in series, divided in stages dependent on the work to be done thereby. Dividing the robots into work stages and disposing them in series in this manner has the advantage of making it unnecessary to consider the effects that the operation of each robot will have on the other stages, and it also facilitates tasks such as work management, stage management, and robot control.

The positioning of robots within a painting line for applying a rust-prevention material and chip guard to the hidden reverse under-surface of the floor of an automobile body B together with that of a sealing line for water-proofing the joints of the automobile body B, which is provided after an electrodeposition painting line constructed according to the above design concept, is shown in FIGS. 7 to 15. In these figures, P denotes a painting robot, S denotes a sealing robot, F denotes a hood-operating robot, and G denotes a trunk-operating robot (a robot for opening and closing the luggage compartment of an automobile).

However, if robots are disposed in the above layout to form a manufacturing line, the length of this line is inevitably long, resulting in the following problems:

1. A large area on site is necessary for the factory building in which the robots are disposed.
2. The conveyor facilities will also become longer, making it necessary to increase the conveyor length and the numbers of hangers and dollies correspondingly.
3. The installation and running costs for air conditioning (including temperature, humidity, and cleanliness control) also increase.
4. It is difficult to recycle non-attached paint materials (which are environmental pollutants) and thus a large quantity of sludge processing water is used.
5. The total time required of tasks (work tasks) for each automobile increases.
6. Since most of the problems with automobile manufacturing lines are related to the conveyor facilities, lengthening the manufacturing line will increase the likelihood that the manufacturing line will be halted by problems in the conveyor facilities.
7. When a manufacturing line has been halted, the quality of paint layers in the painting line deteriorates. Lengthening the manufacturing line increases the drawbacks that such deterioration will occur in the paint quality of large number of automobiles.

It should be noted that a previous proposal related to the positioning of robots for an automobile manufacturing line was disclosed in Japanese Laid-Open Patent Publication (KOKAI) No. 6-654. The objective thereof is to implement uniform additional welding for an entire automobile body at a welding station at the initial end of an additional welding (Mashiuchi) line, to prevent the occurrence of welding distortion at the additional welding stage of this automobile manufacturing line. Side frames 110, each having an upper level 111 and a lower level 112, are provided on each side of a welding station 100, as shown in FIG. 16. The additional welding is performed on joint portions between the floor and side panels of an automobile body B by robots 120 which are mounted on the lower levels 112 and are capable of moving towards and away from the sides of the automobile body B, while the additional welding is performed on joint portions between the roof and side panels of the automobile body B by robots 120 which are mounted on the upper levels 111 and are capable of moving towards and away from the sides of the automobile body B. In addition, two suspended robots 140 are mounted fore and aft from a ceiling framework 130 of the welding station 100 in such a manner that they are free to travel horizontally and are capable of moving vertically. These robots 140 are intended to perform the additional welding on joint portions for other structural members of the automobile body B such as the dashboard.

However, a downflow circulatory system is established in such a painting line to prevent flying dust and dirt from attaching to the automobile body B. When a bulky robot body is moved vertically above the automobile body B, a large disruption (turbulence) is caused in the downflow circulation and the resultant dust and dirt is entrained in the airflow and can attach to the layers of paint, leading to deterioration of the paint quality. Similarly, when such a bulky robot body travels toward the automobile body B when in the vicinity of the automobile, the movement of the robot causes a large disruption in the downflow circulation, and the resultant dust and dirt is entrained in the circulation as described above and can attach to the layers of paint, leading to deterioration of the paint quality. For that reason, the robot positioning layout proposed by the above laid-open patent publication cannot be applied as is to a painting or sealing line.

SUMMARY OF THE INVENTION

The present invention was devised in the light of the above described problems with the prior art, and has a main objective of providing a positioning method and positioning layout that can be used to dispose robots efficiently in an automobile painting and sealing line.

A first aspect of the robot positioning method for an automobile painting line in accordance with this invention relates to a method of positioning robots in an automobile painting line in which downflow circulation is established. A main body of a robot for applying sealant is located in a position at which it does not cause a large disruption (turbulence) in the downflow circulation at the sides of an automobile body, and also a robot for painting a lower surface member is positioned below the automobile body.

A second aspect of the robot positioning method for an automobile painting line in accordance with this invention similarly relates to a method of positioning robots in an automobile painting line in which a downflow circulatory system is established. A main body of a robot for painting an upper surface member is located in a position at which it does not cause a large disruption in the downflow circulation above a automobile body, and also a main body of a robot for painting a side surface member is located in a position at which it does not cause a large disruption in the downflow circulation at the sides of the automobile body.

The first aspect of the robot positioning layout for an automobile painting line in accordance with this invention relates to a layout in which robots are positioned in an automobile painting line in which a downflow circulatory system is established. This automobile painting line is provided with a robot for applying sealant that is disposed in such a manner that a main robot body thereof is at a position at which it does not impede the downflow circulation at the sides of an automobile body, and a robot for painting a lower surface member that is positioned below the automobile body.

The second aspect of the robot positioning layout for an automobile painting line in accordance with this invention relates to a layout in which robots are positioned in an automobile painting line in which a downflow circulatory system is established. This automobile painting line is provided with a robot for painting an upper surface member that is disposed in such a manner that a main robot body thereof is at a position at which it does not impede the downflow circulation above an automobile body, and a robot for painting a side surface member that is disposed in such a manner that a main robot body thereof is at a position at which it does not impede the downflow circulation at the sides of the automobile body.

A third aspect of the robot positioning layout for an automobile painting line in accordance with this invention relates to a layout in which robots are positioned in an automobile painting line comprising a plurality of stations and in which a downflow circulatory system is established. This automobile painting line is provided with a robot for sealing or painting that is disposed in such a manner that a main robot body thereof is at a position at which it does not impede the downflow circulation above an automobile body, and a painting robot disposed at a position lower than that of the sealing or painting robot; and the painting robot is capable of traveling along a traverse axis that extends through the plurality of stations. In this case, the sealing or painting robot that is disposed in an upper position is a robot for painting an upper surface member and the painting robot that is disposed in a lower position is a robot for painting a side surface member or a lower surface member.

In the robot positioning layout for an automobile painting line in accordance with this invention, it is preferable that the arm of each of the sealing and/or painting robots is of a form such that disruption to the downflow circulation by the movement thereof is minimized. This can be accomplished by using a robot piped with hoses through a hollow-wrist of the robot.

Since the first, aspect of this invention is configured as described above, the downflow circulatory system that is established in this painting line is not greatly disrupted thereby, and thus there is no deterioration of the painting quality. This makes it possible to seal the automobile body in parallel with the painting of a lower surface member, such as the painting of a rust-prevention material over the hidden reverse under-surface of the floor, so that the length of the painting and sealing line can be halved. Thus the construction and maintenance costs of the painting and sealing line can be dramatically reduced, and, since the painting and sealing can be done in parallel, the time required for this painting and sealing can be halved, improving its productivity.

Since the second aspect of this invention is configured as described above, the downflow circulatory system that is established in this painting line is not greatly disrupted thereby and paint fragments peeling from the robot arms do not adhere to the paint layers, so that there is no deterioration of the painting quality. Therefore, upper surface members such as the automobile roof can be painted in parallel with lower surface members such as the automobile sides at the same time, so that the length of the painting line itself can be halved. Thus the construction and maintenance costs of the painting line can be dramatically reduced, and, since the painting of upper surface members such as the roof, hood, and trunk can be done in parallel with the painting of lower surface members such as the sides and doors, the time required for this painting can be halved, improving its productivity.

Since the third aspect of this invention is configured as described above, painting can be done throughout a plurality of stations as the painting robot moves along the common traverse axis.

DETAILED DESCRIPTION OF PREFERRED EMBODIMENTS

Preferred embodiments of the present invention will be described below with reference to the accompanying drawings. It should be noted, however, that this invention is not to be taken as being limited to the embodiments described herein.

First Embodiment

Figure 1:
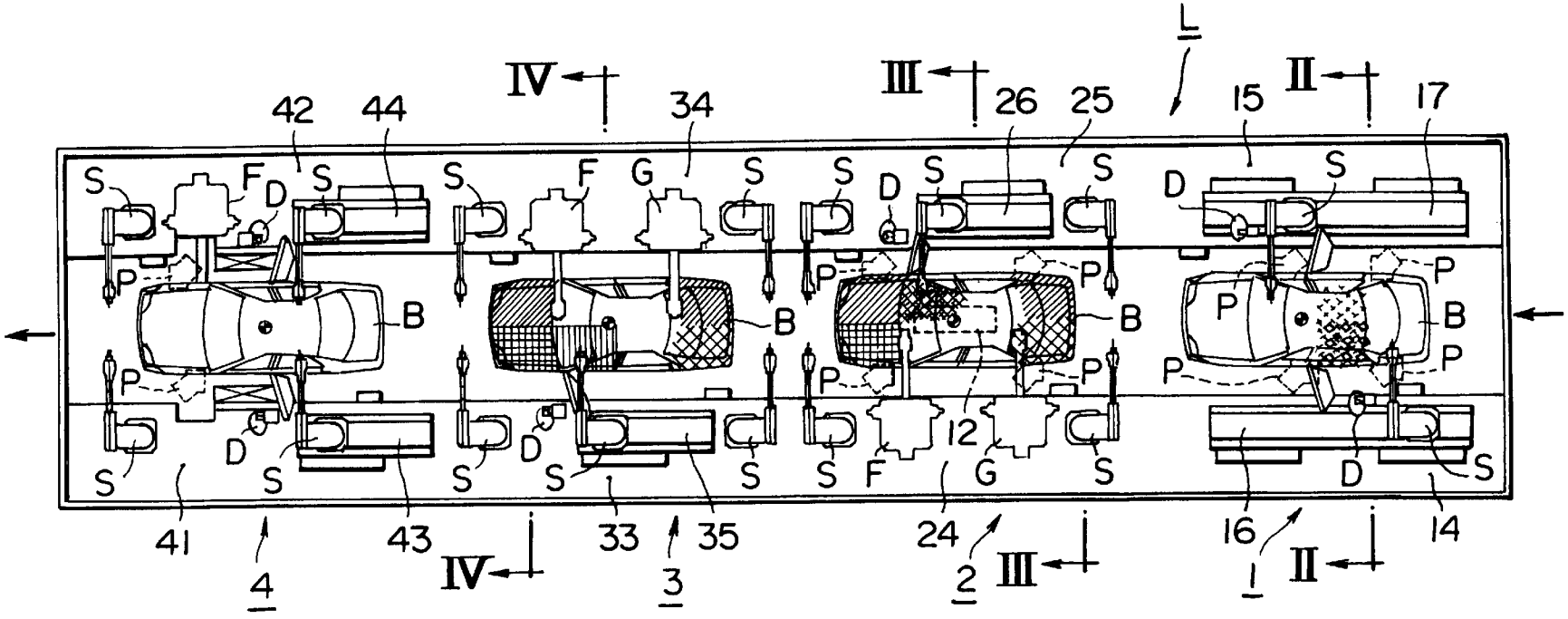
FIG. 1 is a plan view of a first embodiment of the positioning layout in accordance with this invention.
Figure 2:
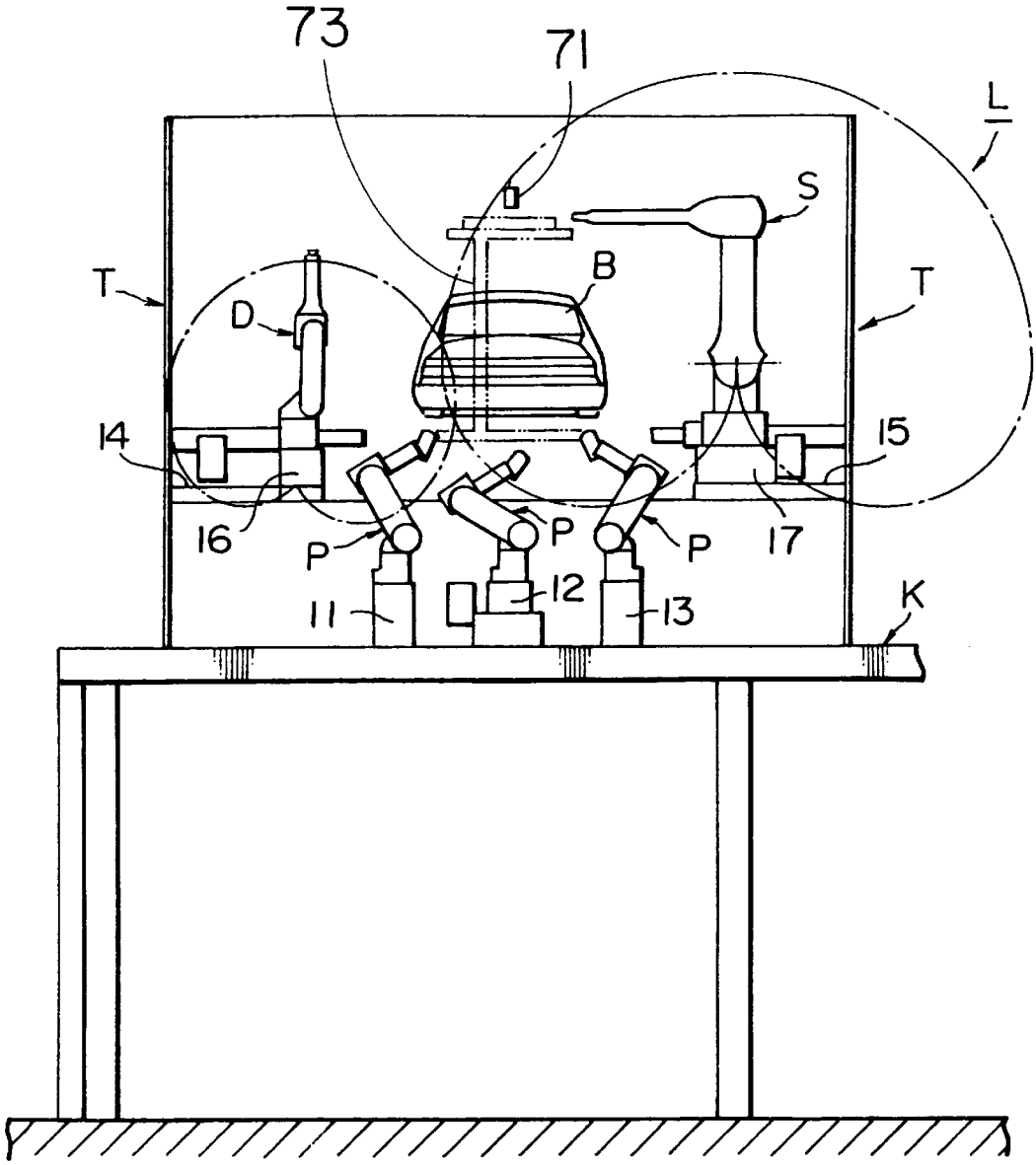
FIG. 2 is a cross-sectional view taken along the line II—II of FIG. 1.
Figure 3:
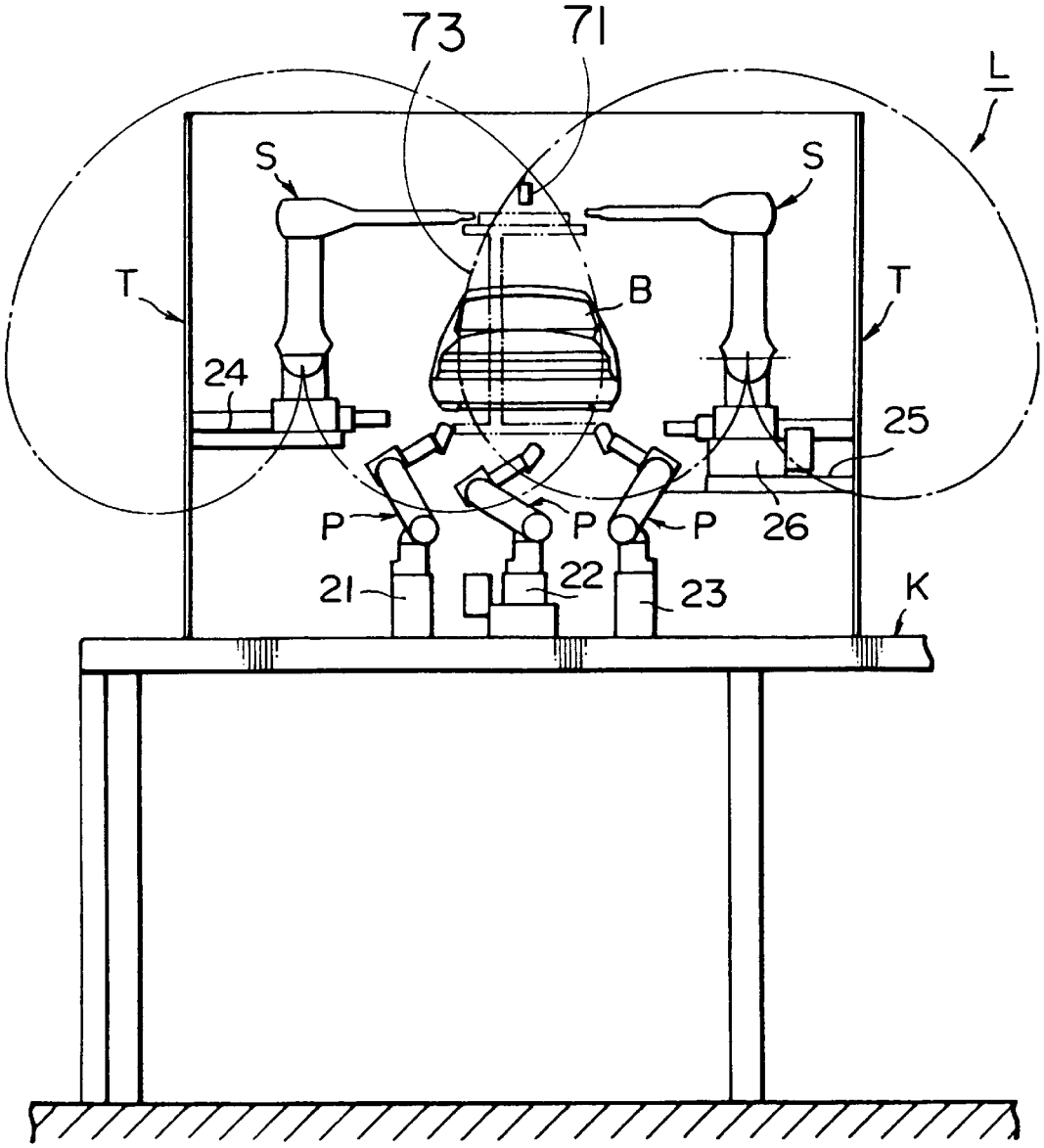
FIG. 3 is a cross-sectional view taken along the line III—III of FIG. 1.
Figure 4:
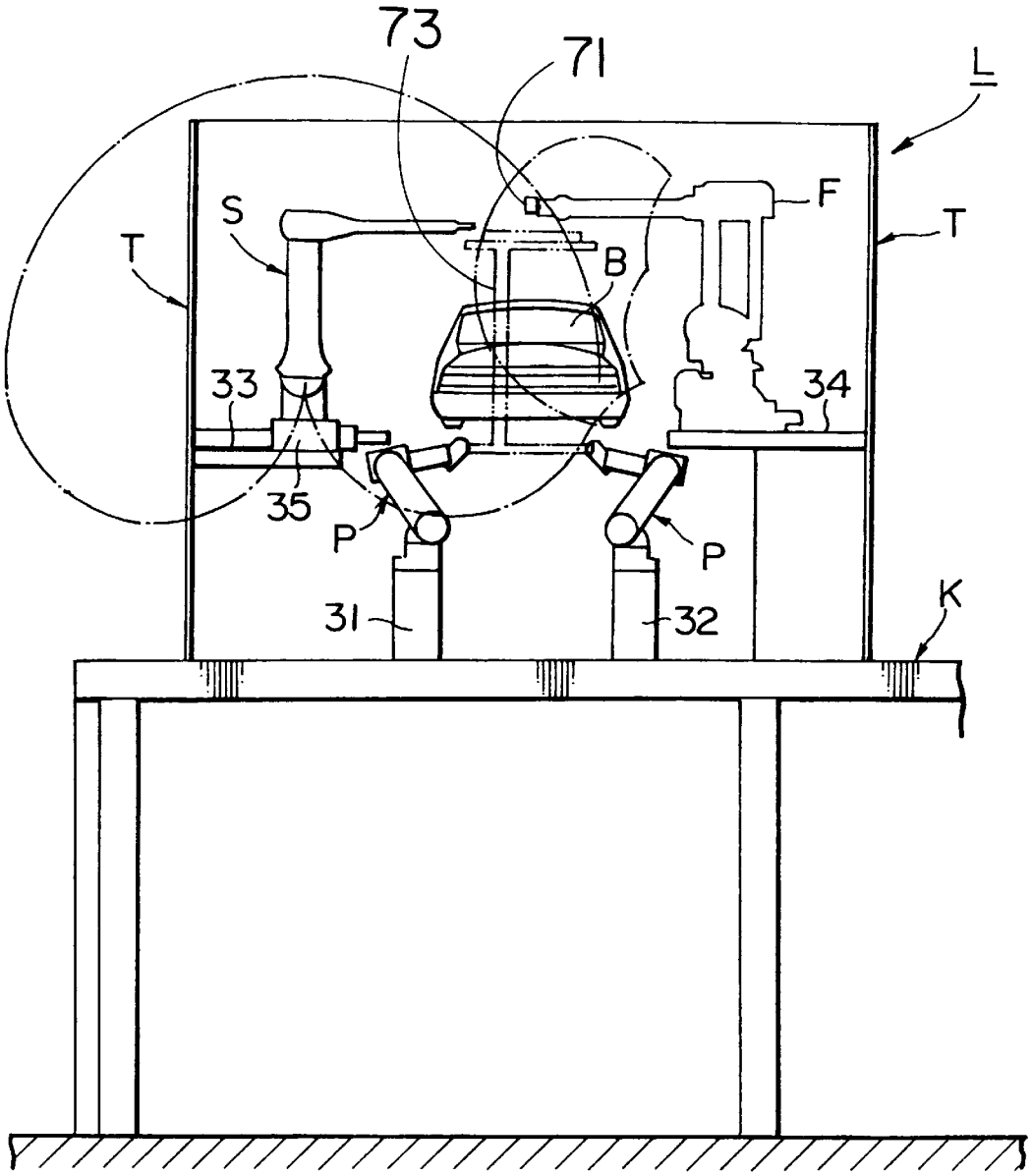
FIG. 4 is a cross-sectional view taken along the line IV—IV of FIG. 1.

An embodiment of a robot positioning layout to which the robot positioning method of this invention is applied is shown in FIGS. 1 to 4. A robot-positioning layout L of this first embodiment is designed to integrate into a painting and sealing line a number of painting robots P (located below an automobile body B, for applying a rust-prevention material and chip-guard coating thereto) and sealing robots S (located on either side of the automobile body B, for applying sealing to joints of the automobile body B), as essential structural components of this line. The robot positioning layout L shown in FIGS. 1 to 4 comprises four stations 1, 2, 3, and 4. The description below is divided into four parts, one for each of these stations 1, 2, 3, and 4 of the robot-positioning layout L. In FIGS. 2, 3 and 4, the numeral 71 indicates a guiding rail disposed over the painting line. The guiding rail is provided with a body carrier 73 that is suspended from the guide rail 71 and supports the automobile body B.

As shown in FIGS. 1 and 2, the first station 1 is provided with a traverse axis 12 disposed in the lengthways direction of the automobile body B on a base K of the painting and sealing line; robot bases 11 and 13; painting robots P provided on each of the traverse axis 12 and the robot bases 11 and 13; work stages 14 and 15 that are provided at a predetermined spacing from the automobile body B on beams (which are not shown in the figure for the sake of clarity) that are at a suitable height above the base K on either side of a painting and sealing booth T; traverse axises 16 and 17 that are disposed at locations where they will not cause a large disruption in the downflow circulatory system, regardless of the movement of the robots on the work stages 14 and 15 (in other words, where they will not cause any problems that will adversely affect the paint layer); sealing robots S traveling along the traverse axes 16 and 17; and rear-door-operating robots D that are located on the work stages 14 and 15 for opening and closing rear doors of the automobile body B.

In this case, each of the painting robots P, sealing robots S, and door-operating robots D is configured of an articulated type robot arm that is well known in the conventional art. In other words, each of the painting robots P is provided with a main robot body that is positioned on a robot base or on a traverse axis in such a manner that it can travel therealong, an arm attached to this main robot body, and a paint gun attached to a free end of this arm. Each of the sealing robots S is provided with a main robot body that travels along a traverse axis disposed as required, an arm attached to this main robot body, and a sealing gun attached to a free end of this arm. It should be noted that a preferred configuration might not be provided with traverse axes, and thus it is not absolutely necessary to provide them. Each of the door-operating robots D is similarly configured of a main robot body, an arm attached to this main robot body, and a suction pad attached to a free end of this arm for opening and closing the door. Each robot arm is long enough to enable the arm to perform the predetermined work thereof, such as painting or sealing, from the position at which the main body of that robot is located. Since a downflow circulatory system is established in this line, as described above, the form of each robot is preferably as narrow as possible and is also streamlined, to ensure that the robot does not cause a large disruption to this downflow circulation wherein the robot piped with hoses through the hollow-wrist is included.

As shown in FIGS. 1 and 3, the second station 2 is provided with a traverse axis 22 disposed in the lengthways direction of the automobile body B on the base K of the painting and sealing line; robot bases 21 and 23; painting robots P provided on each of the traverse axis 22 and the robot bases 21 and 23; work stages 24 and 25 that are provided at a predetermined spacing from the automobile body B on beams (which are not shown in the figure for the sake of clarity) that are at a suitable height above the base K on either side of the painting and sealing booth T; a traverse axis 26 positioned on one of the work stages 24 and 25 (such as the one on the right side of the automobile body B); a sealing robot S that travels along the traverse axis 26 and seals the right side of a front floor; a front-door-operating robot D for opening and closing a front right-side door for this sealing robot S that seals the right side of the front floor; a hood-operating robot F (see FIG. 4) for opening and closing the hood of the automobile and a trunk-operating robot G (see FIG. 1) for opening and closing the trunk, these robots being positioned on the other of the work stages 24 and 25 (such as the one on the left side of the automobile body B); and sealing robots S positioned on each of the work stages 24 and 25, one on each side for sealing the trunk compartment and one on each side for sealing the engine compartment.

Each of the hood-operating robot F, the trunk-operating robot G, and the door-operating robots D is configured of an articulated type robot arm that is well known. Thus, the hood-operating robot F is provided with a main robot body, an arm attached to this main robot body, and a suction pad attached to an free end of this arm for opening and closing the hood. Similarly, the trunk-operating robot G is provided with a main robot body, an arm attached to this main robot body, and a suction pad attached to an free end of this arm for opening and closing the hood trunk. The arms of the hood-operating robot F and trunk-operating robot G are preferably formed to be as narrow as possible and streamlined, in the same manner as described above.

As shown in FIGS. 1 and 4, the third station 3 is provided with two robot bases 31 and 32 disposed in the fourth station 4 on the base K of the painting and sealing line; painting robots P positioned on these robot bases 31 and 32; work stages 34 and 35 that are provided at a predetermined spacing from the automobile body B on beams (which are not shown in the figure for the sake of clarity) that are at a suitable height above the base K on either side of the painting and sealing booth T; a traverse axis 35 positioned on one of the work stages 33 and 34 (such as the one on the left side of the automobile body B); a sealing robot S that travels along the traverse axis 35 and seals the left side of a front floor; a front-door-operating robot D for opening and closing a front left-side door for this sealing robot S that seals the left side of the front floor; a hood-operating robot F for opening and closing the hood of the automobile and a trunk-operating robot G for opening and closing the trunk, these robots being positioned on the other of the work stages 33 and 34 (such as the one on the right side of the automobile body B); and sealing robots S positioned on each of the work stages 33 and 34, one on each side for sealing the trunk compartment and one on each side for sealing the engine compartment.

As shown in FIG. 1, the fourth station 4 is provided with work stages 41 and 42 that are provided at a predetermined spacing from the automobile body B on beams (which are not shown in the figure for the sake of clarity) that are at a suitable height above the base K on either side of the painting and sealing booth T; traverse axes 43 and 44 provided on both sides of the work stages 41 and 42; sealing robots S traveling along the traverse axes 43 and 44 for sealing a rear floor; rear-door-operating robots D for opening and closing rear doors for these sealing robots S that seal the rear floor; a hood-operating robot F for opening and closing the hood of the automobile, positioned on one of the work stages 41 and 42 (such as the one on the right side of the automobile body B); and sealing robots S positioned on each of the work stages 41 and 42 for sealing the engine compartment.

With the positioning layout of this first embodiment of the present invention, constructed as described above: part of the rear floor is sealed in parallel with the painting of a lower surface member (the base of the automobile body) with a material such as a rust-prevention material at the first station; part of the rear floor, part of the trunk compartment, and part of the engine compartment are sealed in parallel with the painting with the rust-prevention material of the under-surface of the floor at the second station; the remainder of the rear floor, the remainder of the trunk compartment, and part of the engine compartment are sealed in parallel with the painting with the rust-prevention material of the hidden reverse under-surface of the floor at the third station; and the remainder of the rear floor and the remainder of the engine compartment are sealed in parallel at the fourth station. In this case, the sealing performed at each station requires that the conveying of the automobile is halted, but the painting of the under-surface of the floor with the rust-prevention material can be done either while the automobile is halted or while it is being conveyed.

In this manner, the positioning layout in accordance with this first embodiment of the present invention places sealing robots in a rust-prevention painting line, which could not be provided with sealing robots in the prior art for fear of disrupting the downflow circulatory system. Thus, sealing can be performed in parallel with the painting of a lower surface member of an automobile with a material such as a rust-prevention material, and therefore this layout can substantially halve the total length of a painting and sealing line.

Although the description of the first embodiment related to separate robot bases and traverse axes on the parts of the base of the line corresponding to the first, second, and third stations, it should be noted that the traverse axes provided on the individual stations could be combined into one common traveling shaft (so-called), and also the same robots can be used for painting from the first station through to the third station. Depending on the configuration used, it might be more efficient to perform the painting while the automobile is being conveyed. In other words, the configuration can be such that the painting is done by a single painting robot in a plurality of stations, including the movement spaces between fixed stations.

Figure 5:
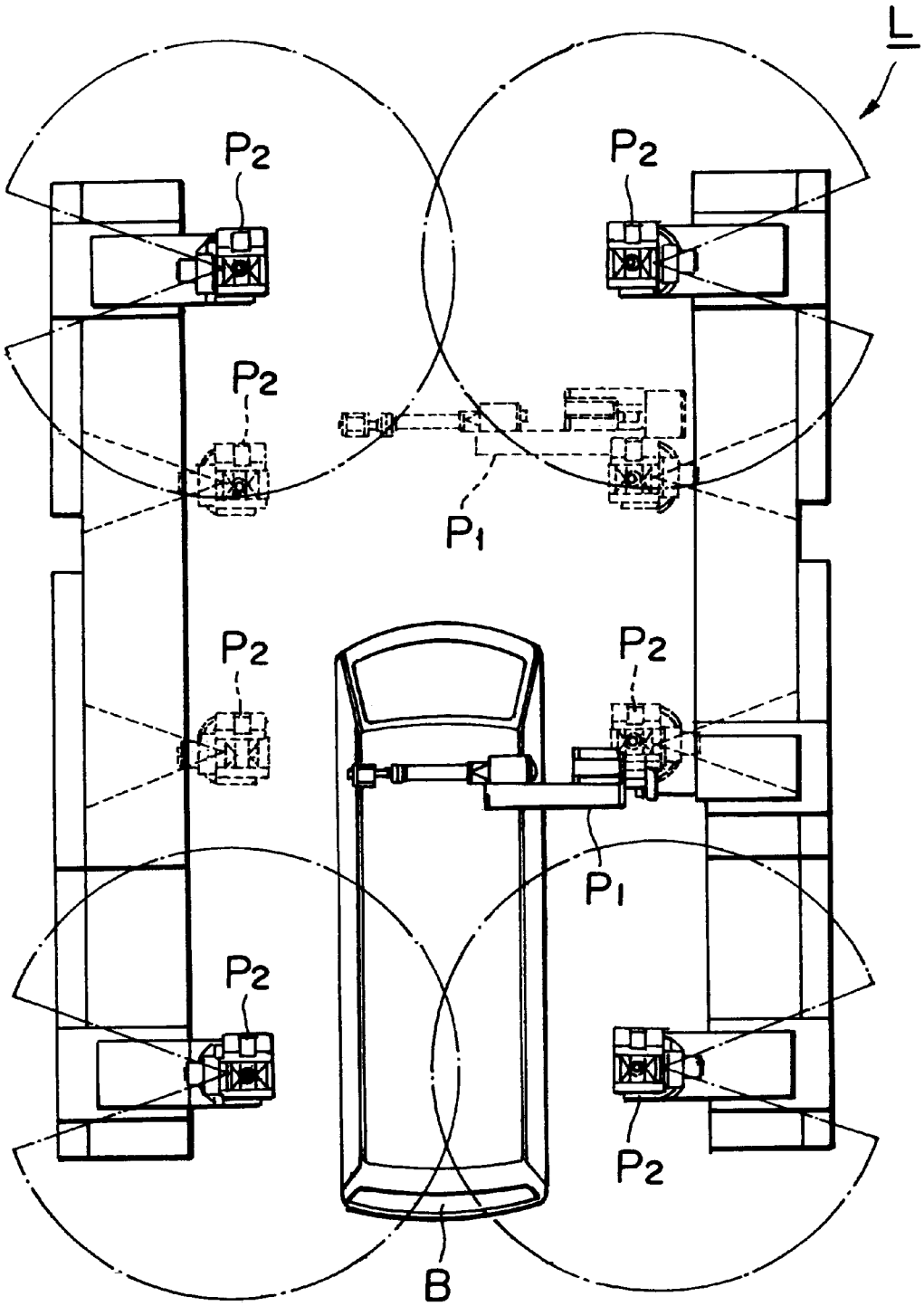
FIG. 5 is a plan view of a second embodiment of the positioning layout in accordance with this invention.
Figure 6:
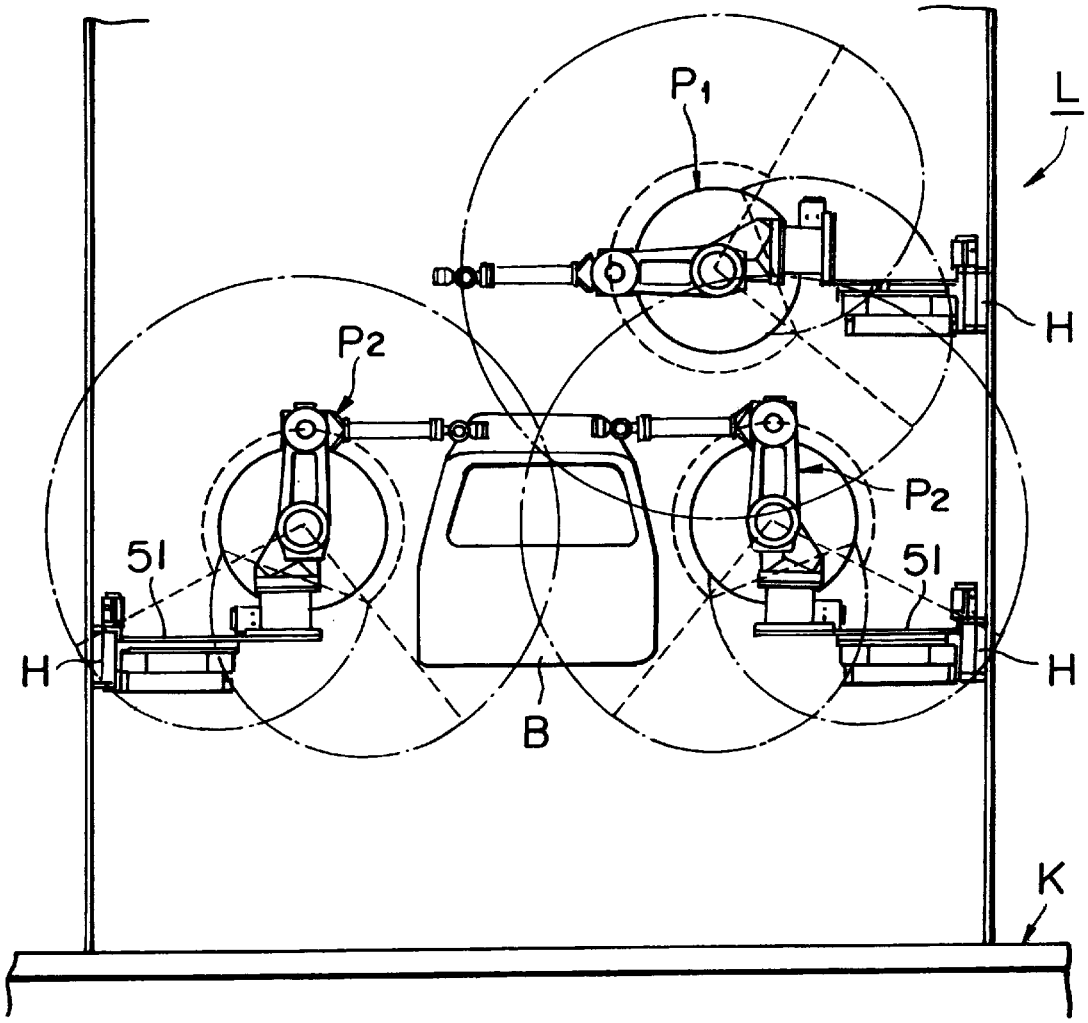
FIG. 6 is a side view of the layout of FIG. 5.
Figure 7:
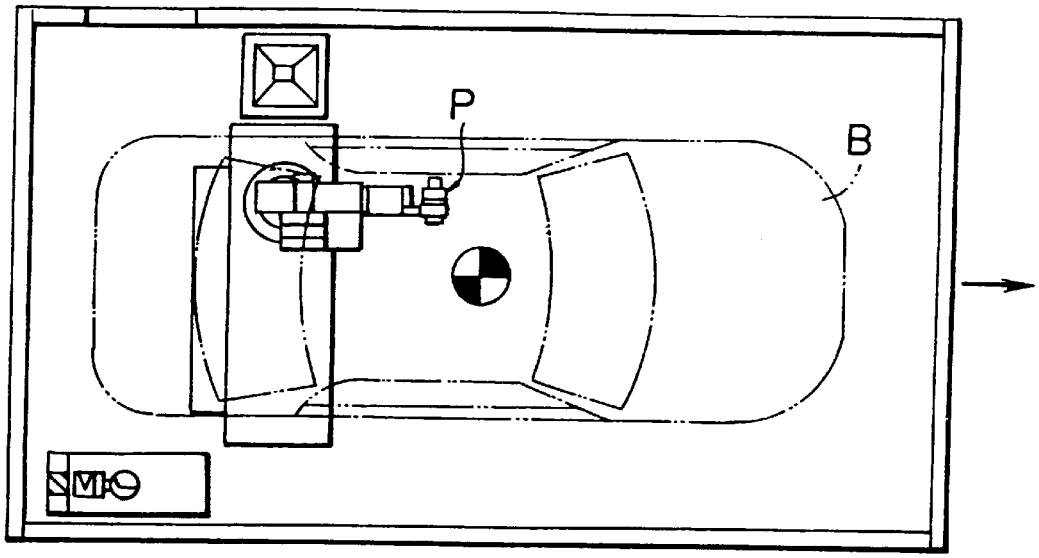
FIG. 7 PRIOR ART
FIG. 7 is a plan view of a positioning layout in a conventional line, in a state before an automobile is conveyed into a floor under-surface painting line.
Figure 8:
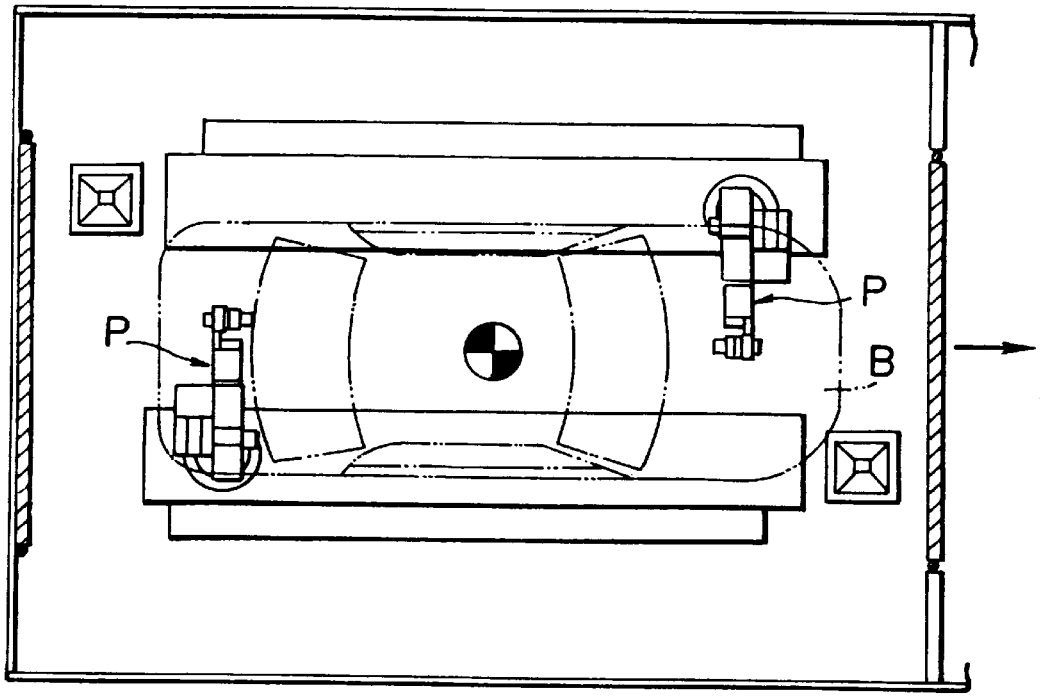
FIG. 8 PRIOR ART
FIG. 8 is a plan view of the positioning layout in a conventional floor under-surface painting line, showing a first stage thereof.
Figure 9:
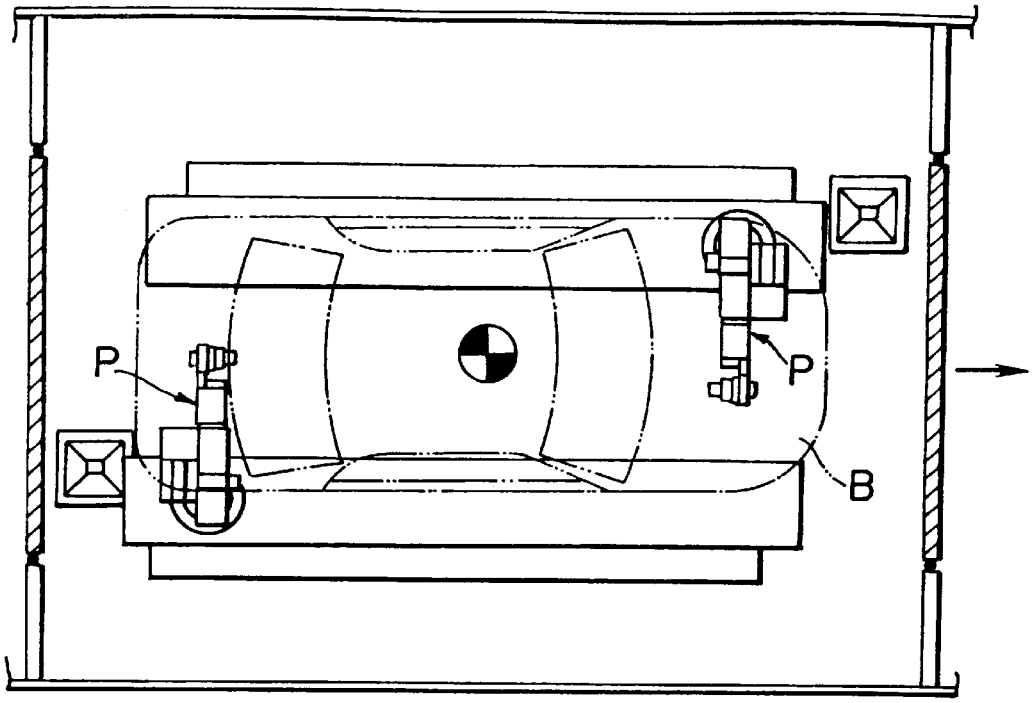
FIG. 9 PRIOR ART
FIG. 9 is a plan view of the positioning layout in a conventional floor under-surface painting line, showing a second stage thereof.
Figure 10:
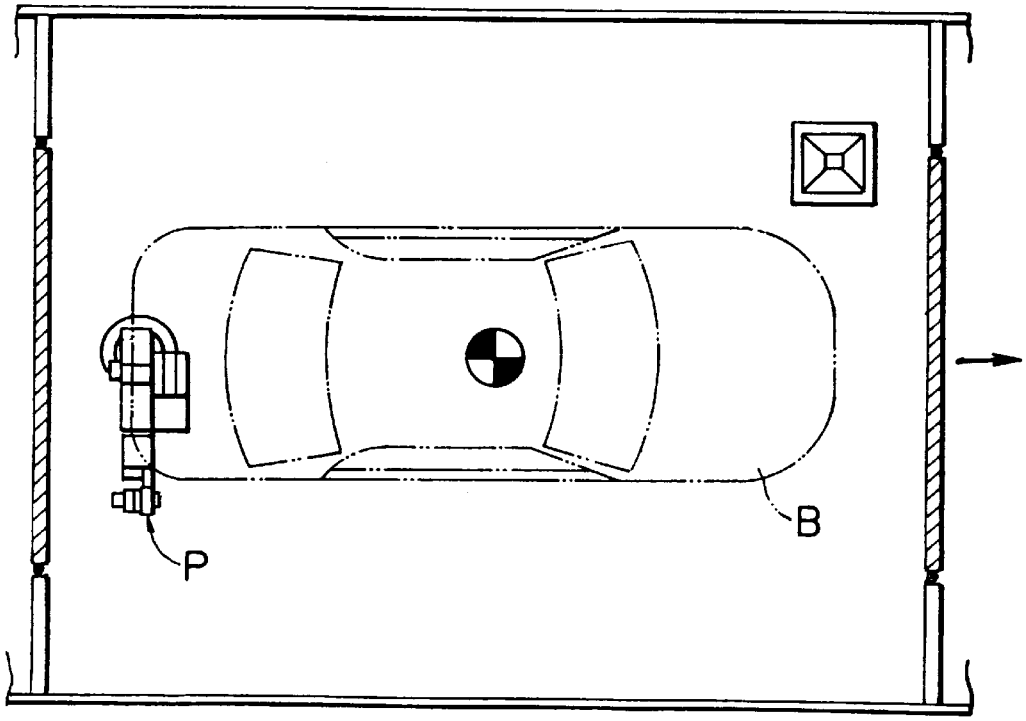
FIG. 10 PRIOR ART
FIG. 10 is a plan view of the positioning layout in a conventional floor under-surface painting line, showing a third stage thereof.
Figure 11:
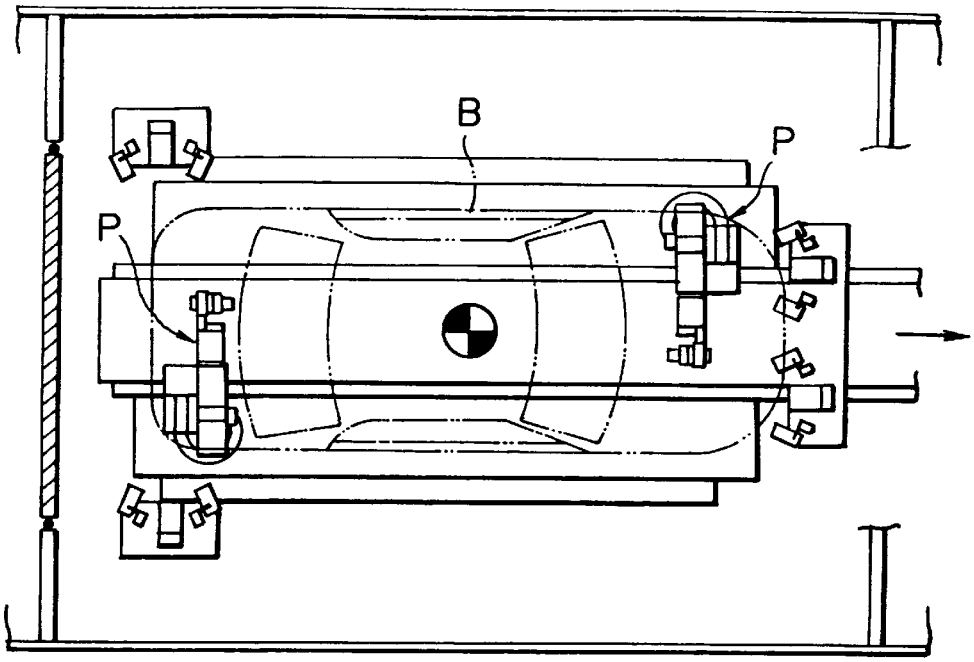
FIG. 11 PRIOR ART
FIG. 11 is a plan view of the positioning layout in a conventional floor under-surface painting line, showing a fourth stage thereof.
Figure 12:
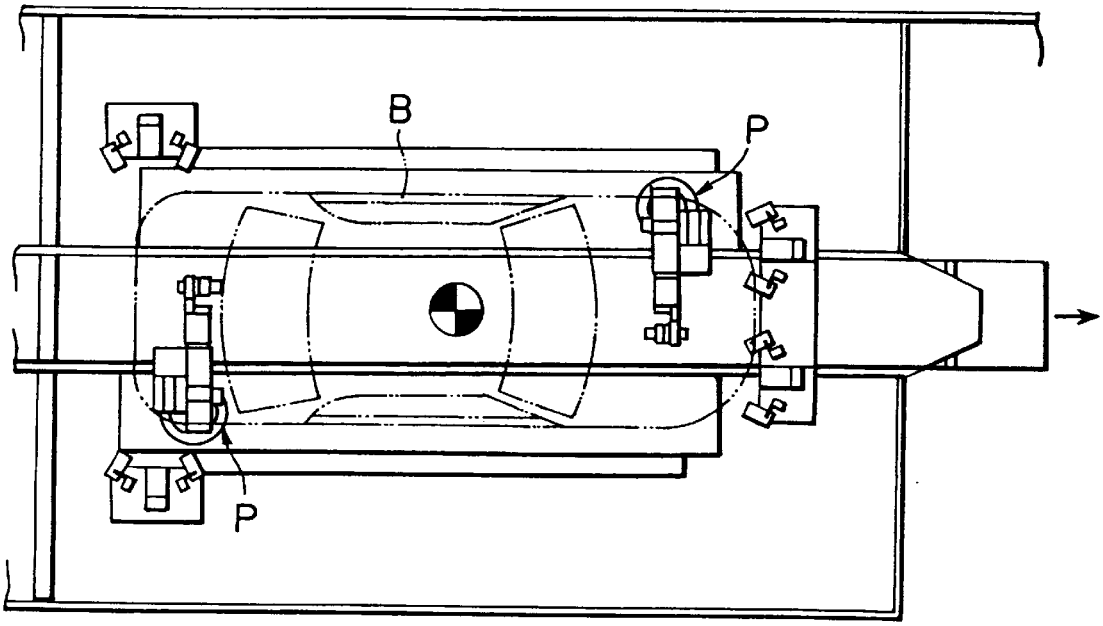
FIG. 12 PRIOR ART
FIG. 12 is a plan view of the positioning layout in a conventional floor under-surface painting line, showing a fifth stage thereof.
Figure 13:
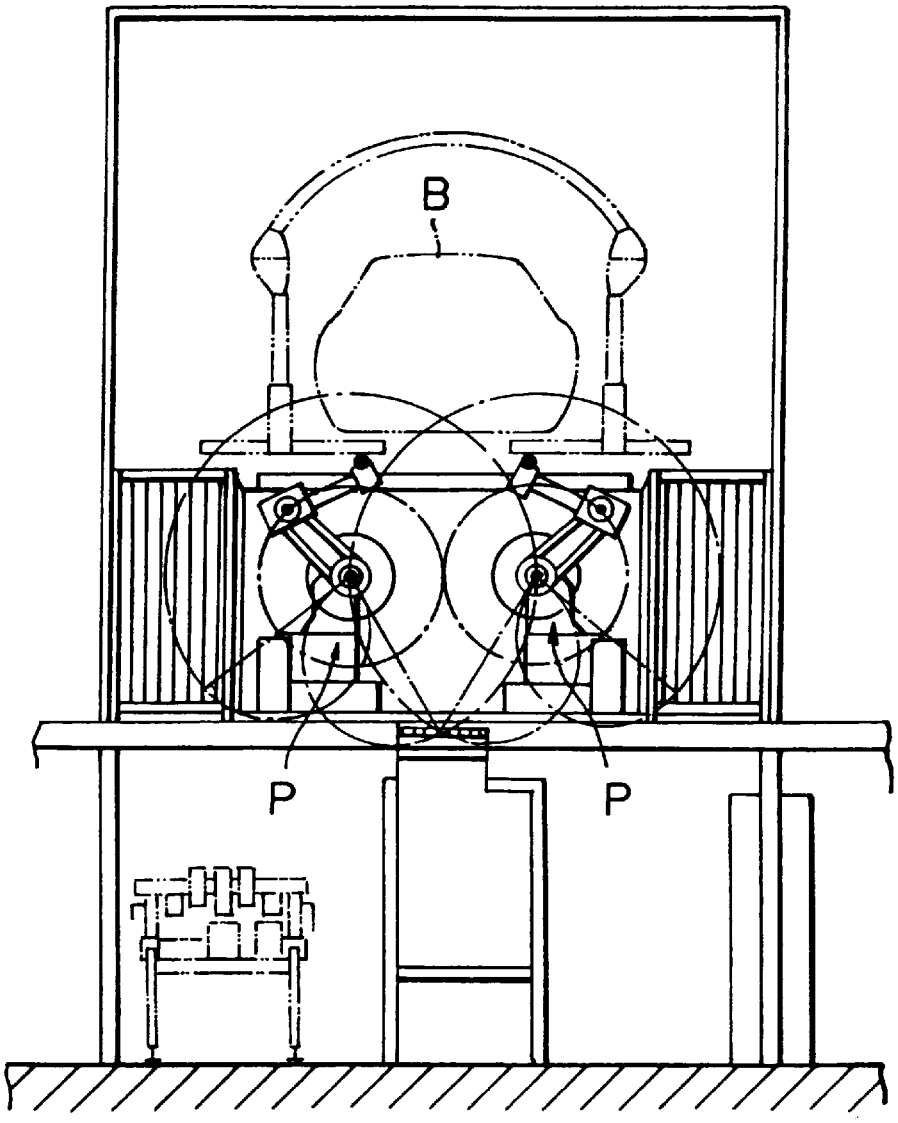
FIG. 13 PRIOR ART
FIG. 13 is a side view of the positioning layout in a conventional floor under-surface painting line, showing a sixth stage thereof.
Figure 14:
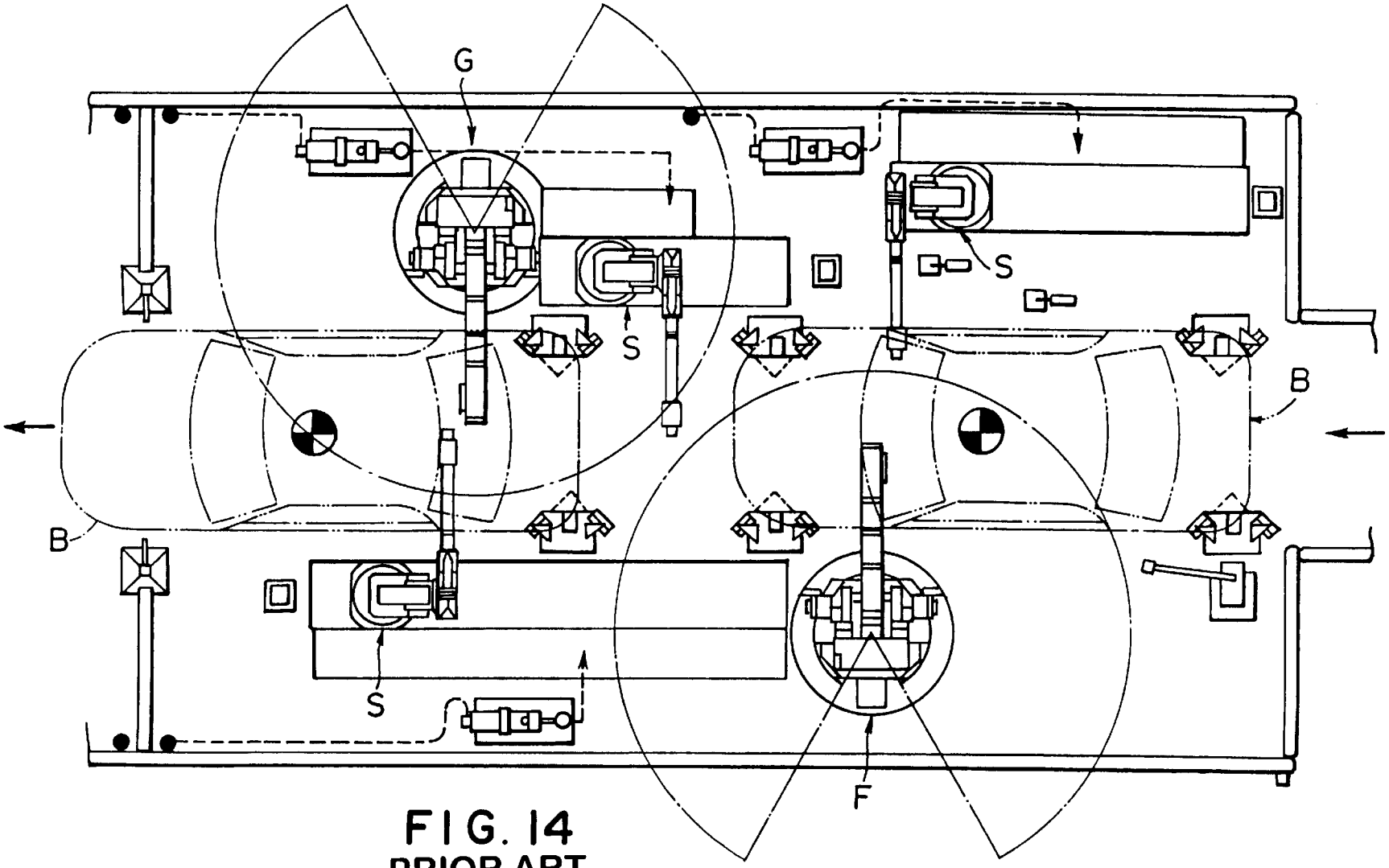
FIG. 14 PRIOR ART
FIG. 14 is a plan view of the positioning layout in a conventional sealing line, showing a first stage thereof.
Figure 15:
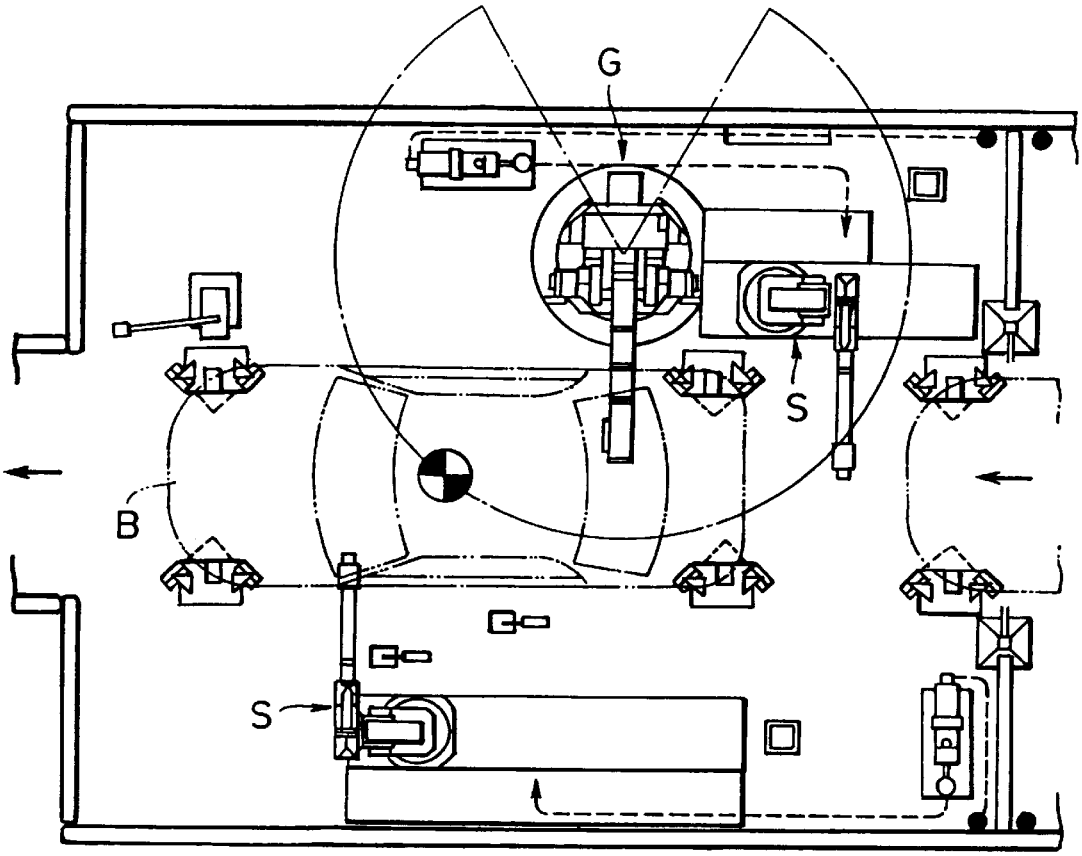
FIG. 15 PRIOR ART
FIG. 15 is a plan view of the positioning layout in a conventional sealing line, showing a second stage thereof.
Figure 16:
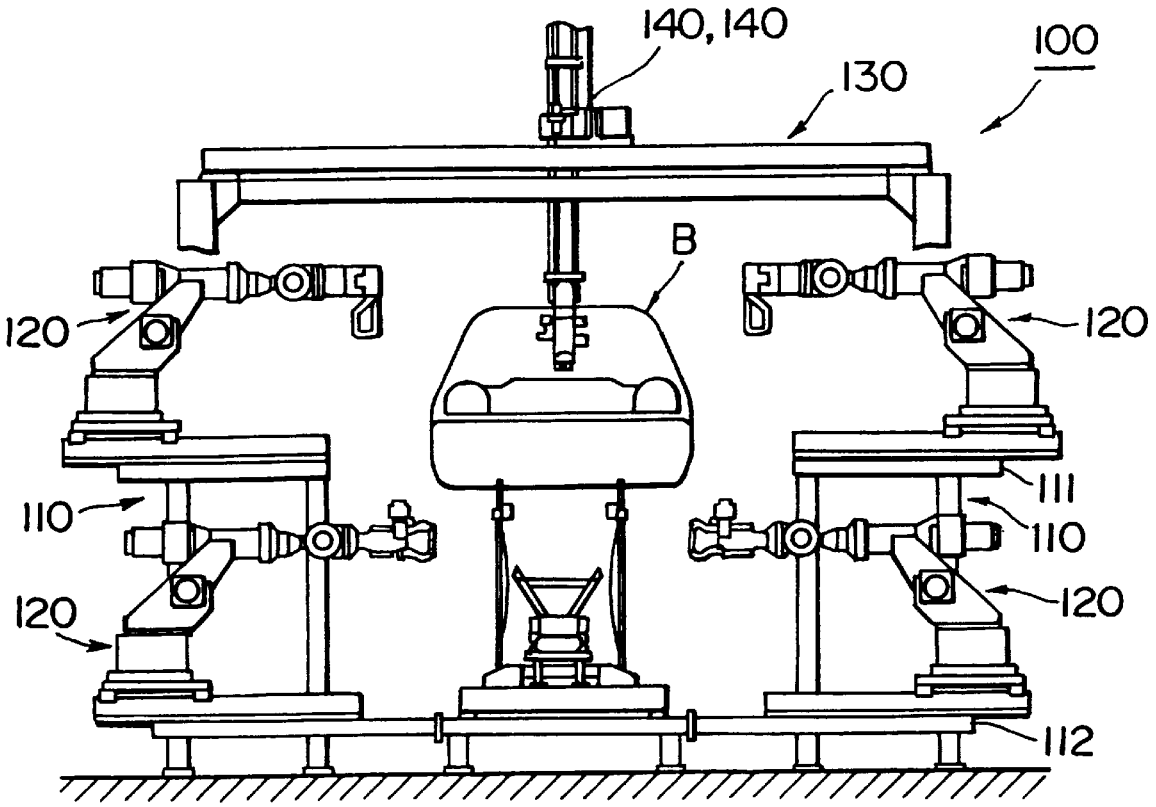
FIG. 16 PRIOR ART
FIG. 16 is an explanatory view of a robot positioning layout as proposed in Japanese Laid-Open Patent Publication No. 6-654.

Furthermore, the positioning layout described by way of the first embodiment is a stratified one in which sealing robots and painting robots at different heights are combined, but this invention can equally well be applied to other forms of stratified positioning layouts such as one in which sealing robots are combined with robots used for applying masking, or with robots for demasking Second Embodiment Essential components of another embodiment of a robot positioning layout using the robot positioning method in accordance with the present invention are shown in FIGS. 5 and 6. The main structural components of the robot positioning layout L of this second embodiment are upper-surface painting robots $P_1$ and side-surface painting robots $P_2$. The upper-surface painting robots $P_1$ are positioned suspended from the walls above both sides of the automobile body B or above one side thereof, for painting members that form upper surfaces of the automobile body B such as the roof, hood, and trunk (luggage compartment). The side-surface painting robots $P_2$ are positioned beside the automobile body B and below the side-surface painting robots $P_2$, for painting side surface members of the automobile body B such as the doors. This layout is designed to create a shorter line comprising painting stages alone.

In this case, the main robot body of each of the upper-surface painting robots $P_1$ and side-surface painting robots $P_2$ is positioned at a predetermined distance from the automobile body B, in such a manner that it does not greatly disrupt the downflow circulatory system that is established therearound. More specifically, each of the upper-surface painting robots $P_1$ is fixed by suitable means to a beam H positioned at a predetermined height above the base K on one or both walls of the painting booth T. Each of the side-surface painting robots $P_2$ runs along one of a plurality of common traverse axes 51 (only two of which are shown in FIG. 6) that are fixed along the lengthwise direction of the automobile body B by suitable means to a beam H (not shown in FIG. 5 for the sake of clarity) that is placed lower than the beam H on which the upper-surface painting robots $P_1$ are placed. In this case, the beam or beams H to which the upper-surface painting robots $P_1$ are attached are designed to be strong enough that no unwanted vibration is generated in the upper-surface painting robots $P_1$ when the side-surface painting robots $P_2$ are moving.

In the same manner as in a sealing process, this embodiment could be designed to ensure that the interior of the automobile body B can also be painted by the upper-surface painting robots $P_1$ and side-surface painting robots $P_2$ from the same positions without further modification. This could be enabled by the provision of door-operating robots or trunk-operating robots, which are mechanisms for opening and closing parts of the automobile body B such as the doors, hood, and trunk thereof.

It should be noted that each of these upper-surface painting robots $P_1$ and side-surface painting robots $P_2$ could be an articulated type robot arm similar to the painting robots P of the first embodiment.

In a similar manner to the first embodiment, the positioning layout in accordance with this second embodiment of the present invention places robots for painting the upper surfaces of an automobile body B, such as the roof, hood, and trunk thereof, in a stage for painting the side surfaces of the automobile body B, which could not be provided with such robots in the prior art for fear of disrupting the downflow circulatory system and contaminating the paint layers with fragments of paint. Thus, since painting of the upper surface members of the automobile body B can be done in parallel with the painting of the side surface members thereof, and therefore this layout can substantially halve the length of the line in a painting stage.

As described above, the first aspect of the present invention utilizes a stratified layout in which sealing robots are disposed in regions to the sides of an automobile in the painting line while painting robots are disposed below the automobile, which could not be used previously for fear of disrupting the downflow circulatory system established in this line. This has the effect of making it possible to halve the total length of the painting and sealing line. Halving the length of the painting and sealing line has the effect of dramatically reducing the construction and running costs of the painting and sealing line. In addition, since the painting and sealing are done in parallel, the total time required for these paintings and sealings can be halved, providing the effect of improving productivity.

The second aspect of the present invention utilizes a stratified layout in which side-surface painting robots are disposed in regions to the sides of an automobile in the painting line while upper-surface painting robots are disposed above the automobile, which could not be used previously for fear of disrupting the downflow circulatory system established in this line. This has the effect of making it possible to halve the length of the entire painting line. Halving the length of the painting line has the effect of dramatically reducing the construction and running costs of the painting line. In addition, since the painting is done in parallel, the total time required for these paintings can be halved, providing the effect of improving productivity.

The third aspect of the present invention makes it possible for a single painting robot to paint in a plurality of stations, including the transfer spaces between the fixed stations, which has the effect of greatly reducing the installation costs thereof.

What is claimed is:

1. A robot positioning method for an automobile painting line that includes:

a first robot that applies sealant only to a first area of an automobile body, the first robot including a main robot body, an articulated arm provided on the main robot body and an ejecting gun provided on an end portion of the arm, a second robot that applies paint only to an under-surface of a floor member of the automobile body, the second robot including a main robot body, an articulated arm provided on the main robot body and an ejecting gun provided on an end portion of the arm, and a downflow circulatory system in a booth, the method comprising the steps of:

positioning the first robot at a side of the automobile body in a station of the booth such that the main robot body of the first robot is located at a position at which the main robot body does not cause a substantial disruption in the downflow circulation at the side of the automobile body in the station; and positioning the second robot below the automobile body in a same vertical plane in which the first robot is positioned in the station;

wherein the first robot applies the sealant only to the first area of the automobile body without applying the sealant to the under-surface of the floor member of the automobile body where the paint is to be applied by the second robot, and the second robot applies the paint only to the under-surface of the floor member of the automobile body without applying the paint to the first area where the sealant is to be applied by the first robot, the first robot applying the sealant and the second robot applying the paint in parallel.

2. A robot positioning layout for an automobile painting line having a plurality of stations and having a downflow circulatory system, comprising:

a first robot that applies sealant only to a first area of an automobile body, the first robot including a main robot body, an articulated arm provided on the main robot body and an ejecting gun provided on an end portion of the arm, the first robot disposed at a side of the automobile body in one of the stations such that the main robot body of the first robot is located at a position at which the main robot body does not cause a substantial disruption in the downflow circulation at the side of the automobile body in the station;

a second robot that applies paint only to an under-surface of a floor member of the automobile body, the second robot including a main robot body, an articulated arm provided on the main robot body and an ejecting gun provided on an end portion of the arm, the second robot positioned below the automobile body; and a traverse axis extending through the plurality of stations and supporting the second robot movably along the traverse axis;

wherein the first robot applies the sealant only to the first area without applying the sealant to the under-surface of the floor member of the automobile body where the paint is to be applied by the second robot, and the second robot applies the paint only to the under-surface of the floor member of the automobile body without applying the paint to the first area where the sealant is to be applied by the first robot, the first robot applying the sealant and the second robot applying the paint in parallel; and wherein the second robot is movable along the traverse axis through the plurality of stations according to the movement of the automobile body, each of the stations having a space of sufficient size to hold an automobile and being interconnected by a conveyor.

3. A robot positioning layout for an automobile painting line having a plurality of stations and having a downflow circulatory system, comprising:

a first robot that applies sealant or paint only to a first area of an automobile body, the first robot including a main robot body, an articulated arm provided on the main robot body and an ejecting gun provided on an end portion of the arm, the first robot disposed at a side of the automobile body such that the main robot body does not cause a substantial disruption in the downflow circulation;

a second robot that applies paint only to a second area of the automobile body that differs from the first area, the second robot including a main robot body, an articulated arm provided on the main robot body and an ejecting gun provided on an end portion of the arm, the second robot disposed at a position lower than the position of the first robot; and a traverse axis extending through the plurality of stations;

wherein the first robot applies the sealant or the paint only to the first area without applying the paint or the sealant to the second area where the paint is to be applied by the second robot, and the second robot applies the paint to the second area without applying the paint to the first area where the sealant or the paint is to be applied by the first robot, the first robot applying the sealant or the paint and the second robot applying the paint, in parallel; and wherein the second robot is movable along the traverse axis through the plurality of stations according to the movement of the automobile body, each of the stations having a space of sufficient size to hold an automobile and being interconnected by a conveyor.

4. A robot positioning layout according to claim 3, wherein:

the arms of the first and second robots have a streamlined shape that does not substantially disrupt the downflow circulation when the arms move, and the first robot is a robot that applies paint to a top surface member of the automobile body and the second robot is a robot that applies paint to a side surface member or to a lower surface member of the automobile body.

5. A robot positioning layout according to claim 4, wherein:

the main robot bodies and the arms of the first and second robots have at least one hose disposed through hollow wrists of the first and second robots.

* * * * *